US006626802B1

(12) United States Patent
Rodgers, Jr.

(10) Patent No.: US 6,626,802 B1
(45) **Date of Patent: *Sep. 30, 2003**

(54) STATIONARY TYPE OF EXERCISE APPARATUS THAT ENABLES MOVEMENT OF THE USER'S FEET IN A RECIPROCATING MOTION

(76) Inventor: Robert E. Rodgers, Jr., 974 Kings Point Dr., Canyon Lake, TX (US) 78133

( * ) Notice: Subject to any disclaimer, the term of this patent is extended or adjusted under 35 U.S.C. 154(b) by 0 days.

This patent is subject to a terminal disclaimer.

(21) Appl. No.: 09/674,322

(22) PCT Filed: Dec. 22, 1999

(86) PCT No.: PCT/US99/30935

§ 371 (c)(1),
(2), (4) Date: Jul. 11, 2001

(87) PCT Pub. No.: WO01/45802

PCT Pub. Date: Jun. 28, 2001

(51) Int. Cl.[7] ..... A63B 21/00; A63B 22/00
(52) U.S. Cl. ..... 482/51; 482/70; 482/110
(58) Field of Search ..... 482/51–53, 57, 482/70, 79–80, 110, 96, 71, 54

(56) References Cited

U.S. PATENT DOCUMENTS

| | | | |
|---|---|---|---|
| 219,439 | A | 9/1879 | Blend |
| 2,603,486 | A | 7/1952 | Hughes |
| 3,316,898 | A | 5/1967 | Brown |
| 3,759,511 | A | 9/1973 | Zinkin et al. |
| 3,941,377 | A | 3/1976 | Lie |
| 4,645,200 | A | 2/1987 | Hix |
| 4,679,786 | A | 7/1987 | Rodgers |
| 4,720,093 | A | 1/1988 | Del Mar |
| 4,869,494 | A | 9/1989 | Lambert, Sr. |
| 4,900,013 | A | 2/1990 | Rodgers, Jr. |
| 4,949,954 | A | 8/1990 | Hix |
| 4,949,993 | A | 8/1990 | Stark et al. |
| 4,989,857 | A | 2/1991 | Kuo |
| 5,039,087 | A | 8/1991 | Kuo |
| 5,039,088 | A | 8/1991 | Shifferaw |
| 5,131,895 | A | 7/1992 | Rogers, Jr. |
| 5,135,447 | A | 8/1992 | Robards, Jr. et al. |
| 5,186,697 | A | 2/1993 | Rennex |
| 5,192,257 | A | 3/1993 | Panasewicz |
| 5,230,677 | A | 7/1993 | Chi |

(List continued on next page.)

FOREIGN PATENT DOCUMENTS

DE 2919494 A 11/1980

*Primary Examiner*—Stephen R. Crow
(74) *Attorney, Agent, or Firm*—Fulbright & Jaworski LLP

(57) ABSTRACT

An exercise apparatus is provided for enabling reciprocating motion of the user's legs or feet while the user remains generally stationary. The apparatus includes a stationary frame, a first longitudinal rail supported, at least partially, by the frame, and a second longitudinal rail also supported, at least partially, by the frame and in generally parallel relation with the first rail. The apparatus further includes a first foot carriage assembly movably engageable along the first rail, a second foot carriage assembly movably engageable along the second rail, and an inertia drive assembly disposed proximate the first and second rails. The inertia drive assembly includes a first continuous belt that is engageable with the first carriage assembly such that movable operation of the first carriage assembly drives the inertia drive assembly, and a second continuous belt engageable with the second carriage assembly such that movable operation of the second carriage assembly also drives the inertia drive assembly. The first and second carriage assembly are interconnected such that, as each of the first and second carriage assembly initially advances rearwardly or forwardly along one of the rails, the inertia drive assembly can accelerate each carriage assembly, by way of one of the first and second belts.

53 Claims, 5 Drawing Sheets

U.S. PATENT DOCUMENTS 5,242,343 A 9/1993 Miller
5,295,928 A 3/1994 Rennex
5,328,427 A 7/1994 Sleamaker
5,336,143 A 8/1994 Wu
5,383,829 A 1/1995 Miller
5,527,246 A 6/1996 Rodgers, Jr.
5,529,555 A 6/1996 Rodgers, Jr.
5,540,637 A 7/1996 Rodgers, Jr.
5,549,526 A 8/1996 Rodgers, Jr.
5,573,480 A 11/1996 Rodgers, Jr.
5,591,107 A 1/1997 Rodgers, Jr.
5,593,371 A 1/1997 Rodgers, Jr.
5,593,372 A 1/1997 Rodgers, Jr.
5,595,553 A 1/1997 Rodgers, Jr.
5,611,757 A 3/1997 Rodgers, Jr.
5,611,758 A 3/1997 Rodgers, Jr.
5,637,058 A 6/1997 Rodgers, Jr.
5,653,662 A 8/1997 Rodgers, Jr.
5,683,333 A 11/1997 Rodgers, Jr.
5,690,589 A 11/1997 Rodgers, Jr.
5,738,614 A 4/1998 Rodgers, Jr.
5,743,834 A 4/1998 Rodgers, Jr.
5,766,113 A 6/1998 Rodgers, Jr.
5,772,558 A 6/1998 Rodgers, Jr.
5,792,026 A 8/1998 Maresh et al.
5,792,029 A 8/1998 Gordon
5,803,871 A 9/1998 Stearns et al.
5,813,949 A 9/1998 Rodgers, Jr.
5,836,854 A 11/1998 Kuo
5,848,954 A 12/1998 Stearns et al.
5,879,271 A 3/1999 Stearns et al.
5,882,281 A 3/1999 Stearns et al.
5,924,962 A 7/1999 Rodgers, Jr.
5,938,567 A 8/1999 Rodgers, Jr.
5,989,163 A 11/1999 Rodgers, Jr.

STATIONARY TYPE OF EXERCISE APPARATUS THAT ENABLES MOVEMENT OF THE USER'S FEET IN A RECIPROCATING MOTION

BACKGROUND OF THE INVENTION

The present invention relates generally to an exercise apparatus and, more particularly, to an exercise apparatus that enables the user to move his feet or legs in a reciprocating motion while remaining stationary.

Running, walking, skiing and other activities wherein the feet or legs are moved in a reciprocating motion are considered effective forms of exercise. These activities help to load the cardiovascular system as well as build muscle mass. Accordingly, exercise apparatus exist which attempt to simulate these activities. A typical prior art apparatus is designed to enable the user to exercise within an enclosed structure while obtaining most of the benefits of these simulate activities. The apparatus disclosed in U.S. Pat. No. 3,941,377 (hereby incorporated by reference) allows for variable resistance to be employed when foot carriages are moved rearwardly, but allows for generally un-resisted movement of the foot carriage in the forwardly direction. U.S. Pat. No. 4,684,121 (hereby incorporated by reference) discloses, on the other hand, an apparatus that may be used to simulate a skiing motion or a rowing motion. Adapted for a skiing exercise, the foot carriages disclosed can be moved along rails and against a variable resistance. The resistance is constant regardless of the direction of the movement of the foot carriages.

Operation of most, if not all, of the exercise apparatus in the prior art fails to accurately represent or simulate the actual physical activity. Many of these exercise apparatus require the user to exert some force other than force required in the normal exercise activity to operate the system. For example, the user may be required to exert additional force to accelerate a pedal or foot block back to a system speed. Application of such force during the simulated activity is unnatural and is not representative of the actual activity. Furthermore, the application of such force usually creates undesirable resistant forces which impact the user.

SUMMARY OF THE INVENTION

It is one of several objects of the present invention to provide a stationary type of exercise apparatus that is operable to simulate activity wherein the feet or legs are moved in a reciprocating motion, such as running, walking and skiing activities. Another object of the invention is to provide an apparatus for simulating such exercise activities in a manner that more closely represents the actual physical activity and/or causes relatively low impact to the user. A further object of the invention is to provide at least one embodiment, the operation of which involves utilization of inertia in the moving components of the apparatus to accelerate foot travelers or foot carriage assemblies. Preferably, the exercise apparatus is operable without requiring the user to exert additional force to operate the moving components of the apparatus.

In one aspect of the invention, an exercise apparatus is provided for enabling reciprocating motion of the user's legs or feet while the user remains generally stationary. The inventive apparatus includes a stationary frame, a first longitudinal rail supported, at least partially, by the frame, and a second longitudinal rail also supported, at least partially, by the frame and in generally parallel relation with the first rail. The apparatus further includes a first foot carriage assembly (or foot traveler) that is movably engageable along the first rail, a second foot carriage (or foot traveler) that is movably engageable along the second rail, and an inertia drive assembly disposed proximate the first and second rails. The inertia drive assembly includes a first transmission device (preferably a continuous belt) that is engageable with the first carriage assembly such that movable operation of the first carriage assembly drives the inertia drive assembly, and a second transmission device (preferably a continuous belt) engageable with the second carriage such that movable operation of the second carriage also drives the inertia drive assembly. Moreover, the first and second carriage assemblies are interconnected such that the inertia drive assembly canaccelerate each carriage (e.g., as each of the first and second carriage assemblies initially advances rearwardly or forwardly along one of the rails) by way of one of the first and second transmission devices.

The inertia drive assembly and the first or second carriage assemblies may be interconnected such that as the first or second carriage initially advances from a point of change in direction (rearwardly or forwardly), the inertia drive assembly can accelerate the carriage assembly up to a predetermined velocity without the user having to exert additional force to accelerate the carriage assembly. In one embodiment, each of the first and second carriage assemblies is frictionally engageable with one of the first and second belts (i.e., first and second transmission devices) to drive the belt in a first direction when the first or second carriage is moved in the first direction. Further, the first or second carriage is disengageable from a substantially frictionally engaged relation (attached and/or movable therewith) with the belt to move in a second direction opposite the first direction. Further yet, the first and second carriage assemblies may be interconnected (i.e., by a common continuous belt) such that each carriage assembly may be accelerated in the second direction by the inertia drive assembly. More particularly, the first carriage assembly may be accelerated in the second direction through rotation of the second belt by the inertia drive assembly (and transmission of this rotation through the common continuous belt) and the second carriage assembly may be accelerated through rotation of the first belt by the inertia drive assembly (and transmission of this rotation through the common continuous belt).

In another aspect of the invention, an exercise apparatus is provided that has a stationary frame, first and second longitudinal rails each supported, at least partially, by the frame and in generally parallel relation. The apparatus also has a first foot carriage assembly movably engageable along the first rail, a second foot carriage movably engageable along the second rail, and an inertia drive assembly that includes a first energy device. The inertia drive assembly is disposed proximate the first and second rails and is engageable with the first and second carriages such that, as the first or second carriage initially advances rearwardly or forwardly along one of the rails, the first energy device is usable to accelerate the carriage assembly. The apparatus also has a second energy device (i.e., distinct from the first energy device) that is engageable with the inertia drive assembly and adapted to transmit energy thereto. Preferably, the first energy device is a flywheel rotatably mounted on an inertia drive shaft of the drive assembly and the second energy device is a motor that is engageable with the inertia drive assembly (e.g., operably connected or coupled with the inertia drive shaft).

In one embodiment, the motor is operable to continuously transmit power to the inertia drive assembly during operation of the exercise apparatus by the user. In this way, the motor is used to compensate for frictional losses, inertia directional losses, and other energy losses inherent in the operation of the apparatus. The motor may also be used (in conjunction with or in lieu of the first energy device) to accelerate each of the foot carriage assemblies to a predetermined speed upon a change in direction.

In yet another aspect of the invention, an exercise apparatus is provided that includes a stationary frame, first and second longitudinal rails supported, at least partially, by the frame and in generally parallel relation. The apparatus also includes a first foot carriage assembly movably engageable along the first rail, a second foot carriage assembly movably engageable along the second rail and a drive assembly (e.g., an inertia drive assembly) disposed proximate the first and second rails and drivable upon movable operation of the first or second carriage assembly. The drive assembly includes first and second continuous belts, each of which is engageable with a first or second carriage assembly. Further, each of the first and second belts is rotatably supported by a suspension system that includes a resilient support assembly responsive to deflection of the belt upon frictional engagement between the belt and a carriage assembly.

The resilient support assembly is preferably interconnected with the first or second belt so as to further tension the belt upon frictional engagement with the carriage assembly. The support assembly may include a spring device interconnected with the belt which acts to resist deflection of the belt. The support assembly may also include a movable pulley interconnected with the spring device and rotatably supporting the belt. The movable pulley is preferably supported so as to be shiftable upon deflection of the belt.

In further embodiments of the invention, the movable or shiftable pulley is supported on a pivotable arm and is arcuately or rotatably movable about its pivot point upon loading of the belt by one of the carriage assemblies. A spring or tensioning device is preferably attached to the pivot arm so as to be responsive to deflection of the first or second belt. In this way, the spring device provides resilient resistance (and bias) against loading of the belt by one of the carriage assemblies. One advantageous result of this is that impact experienced by the user (e.g., when the user steps down on the carriage assembly to change its direction or to transfer weight) is minimized.

Other and further objects, features, and advantages of the present invention will be apparent from the following description of a presently preferred embodiment(s) of the invention, given for the purpose of disclosure, and taken in conjunction with the accompanying drawing.

BRIEF DESCRIPTION OF THE DRAWINGS

A better understanding of the present invention can be obtained when the following detailed description of the preferred embodiment is considered in conjunction with the following Figures, in which.

DETAILED DESCRIPTION OF THE DRAWINGS

FIGS. 1–4 depict an exercise apparatus 20 embodying the invention. The exercise apparatus 20 is of a stationary type that enables a user to reciprocate motion of his/her feet or legs so as to simulate running, walking and similar physical activity, while the user remains generally stationary. It should be noted that the structural configuration of exercise apparatus 20 and its particular operation are exemplary and are described herein to facilitate description of multiple aspects of the invention which are applicable and adaptable to other types of exercise apparatus. Upon reading the description and/or viewing the Figures, such applications, adaptations and extensions of the invention shall become apparent to one skilled in the relevant mechanical or structural art.

Figure 1:
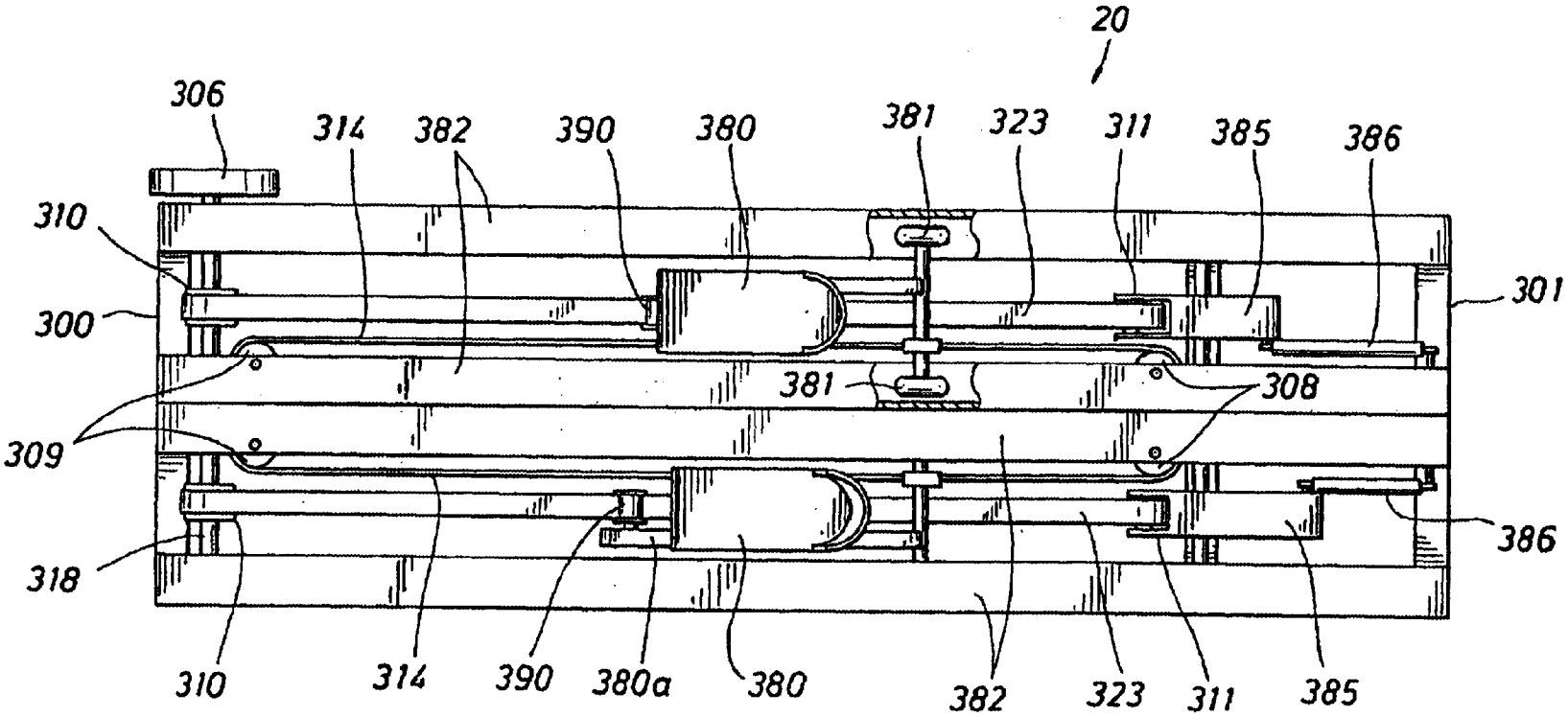
FIG. 1 is a plan view of an exercise apparatus embodying the present invention.

With reference to FIGS. 1–4, exercise apparatus 20 includes a rear frame 300, a front frame 301 and two pairs of longitudinal rails 382 which connect frames 300, 301 and extends therebetween. In the embodiment of FIG. 1, front frame 301 and rear frame 300 are supported on the floor and remain stationary during operation of exercise apparatus 20, as do longitudinal rails 382. Exercise apparatus 20 may also be equipped with a stand that is connected to front frame 301. Such a stand is used to house panels, gauges or displays which may indicate, for example, exercise time and energy expended. Accessories such as handles and armrests may also be supported on this stand. Front frame 301 may be further equipped with an elevation adjustment arm that is pivotally attached to front frame 301. Such an elevation adjustment arm will typically be supported near the front end of stationary exercise apparatus 20 and manually operable to adjust the elevation of the front end of stationary exercise apparatus 20. Accordingly, exercise apparatus 20 may be placed in an inclined position such that the front end is elevated above the rear end thereby increasing the difficulty of the exercise.

Figure 2:
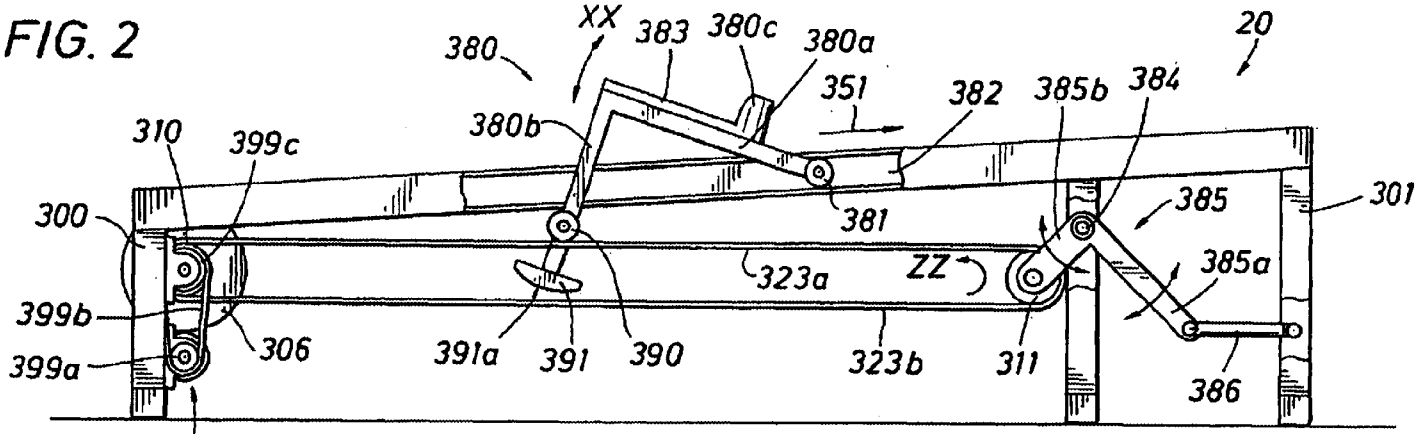
FIG. 2 is an elevation view of the exercise apparatus in FIG. 1 showing a foot carriage assembly in a forward moving mode.
Figure 3:
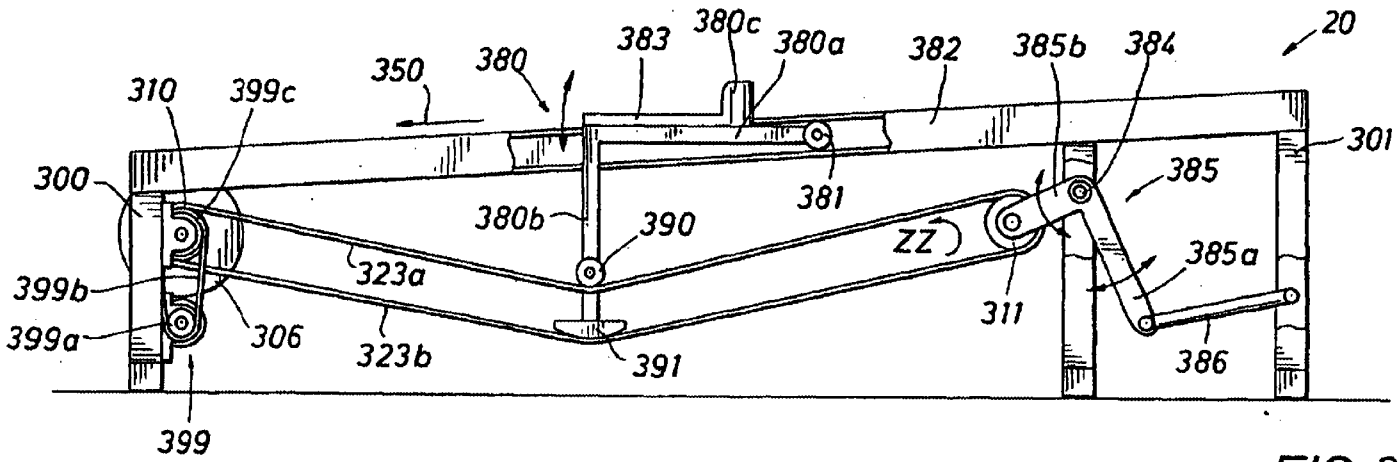
FIG. 3 is an elevation view of the exercise apparatus in FIG. 1 showing the foot carriage assembly in a rearward moving mode.

As shown in FIG. 1, the pairs of rails 382 are disposed in generally parallel relation and are spaced apart to approximate the width of the user's stance. Referring to FIGS. 2 and 3, foot carriage assemblies or travelers 380 are movably attached to rails 382 and include a foot attachment carriage or foot base portion 380*a* and wheels 381 attached to the foot base portion 380*a*. The wheels 381, as will be shown below, are designed to rollably engage and ride along rails 382. For engaging a user's foot, traveler 380 is equipped with a foot pedal 383 disposed on a top surface of foot base portion 380*a* and above rails 382, and a foot toe piece 380*c* integrated or attached thereto. Traveler 380 also includes a generally downwardly extending pressure arm 380*b*.

As will be further described below, when foot base portion 380*b* is forced into a substantially horizontal attitude, which occurs when the user is exerting force onto or through foot pedal 383, traveler 380 is advanced into an active position and then moved rearward from the front end of exercise apparatus 20 to the rear end of the exercise apparatus 20 (see mode illustrated in FIG. 3 as illustrated by the direction of arrow 350). This travel segment may be referred to as a rearward or power stroke in that the user is exerting force onto the exercise apparatus 20. In other words, the user pushes the foot pedal 383 which moves the traveler 380 rearwardly toward rear frame 300. When the user removes weight from the foot base portion 380*b*, traveler 380 returns automatically to an inclined or inactive position and is then moved from the rear end of exercise apparatus 20 to the front end of exercise apparatus 20 where it is prepared for another power stroke (see mode illustrated in FIG. 2 as illustrated by the direction of arrow 351). This travel segment may be referred to as the forward or return stroke. In one aspect of the invention further described below, operation of apparatus 20 does not require for the user to exert additional force to change the moving direction of traveler 382 (e.g. to change from the rearward moving direction to the forward moving direction).

Figure 4:
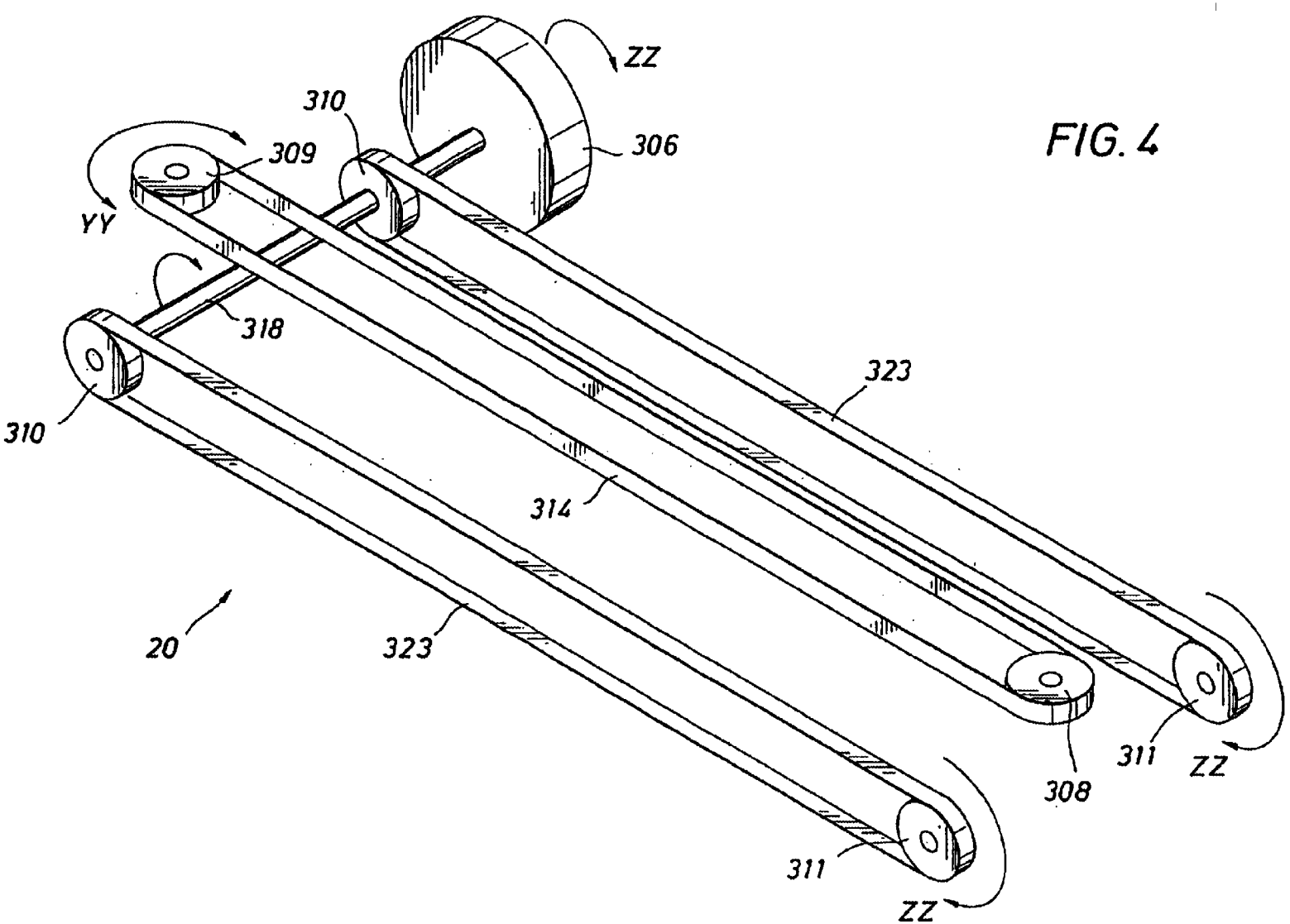
FIG. 4 is a view of certain movable portions of the exercise apparatus in FIG. 1.

Other aspects of the invention are embodied in an improved inertia transfer portion of the exercise apparatus 20. Most of the components which may be described as of the inertia transfer assembly or inertia drive assembly are located generally adjacent rear frame 300, but may be located, in further embodiments, elsewhere around the structure of the exercise apparatus 20. Referring to FIGS. 1–4, the inertia transfer assembly may be described as an assembly including a pair of vertically disposed front drive pulleys 310, an inertia drive shaft 318 extending perpendicularly through the two drive pulleys 310, and a first energy source or front flywheel/brake 306 rotatable with inertia drive shaft 318 and drive pulleys 310. Flywheel 306 may include a brake system to increase or decrease resistance, well known to those skilled in the art. Such a brake may include a mechanical band brake system or an electromagnetic brake system, or an air-fan brake system. Referring to FIG. 4, which better illustrates certain of the movable components of the exercise apparatus 20, front drive pulleys 310 are fixedly attached to and rotatable with inertia drive shaft 318 which is also fixedly attached with flywheel/brake 306. The inertia transfer assembly may also be described as further including a pair of vertically oriented continuous inertia belts 323 which are disposed in rotational relation about the pair of drive pulleys 310 on the rear end and about a pair of idler pulleys 311 on the front end. As discussed below, inertia belt 323, inertia shaft 318 and the components mounted to inertia drive shaft 318 are rotatable in the clockwise direction (for purposes of the present description) as indicated by arrows ZZ in FIG. 4.

It should be noted that shaft 318, pulleys 310, 311 and,belts 323 which are integrated in exercise apparatus 20 are conventional energy transmission devices. Upon reading the description and viewing the drawings, it shall be apparent to one skilled in the mechanical art to adapt the inventive exercise apparatus 20 so as to integrate alternate transmission devices and achieve many of the advantages and attributes associated with the embodiment described herein.

In one aspect of the invention, exercise apparatus 20, or more particularly, the inertia transfer portion, does not employ clutch pulleys, clutch belts and other transmission devices which have been employed in the prior art. One result is that exercise apparatus 20 employs a simpler, more efficient design, which can be operated with greater ease and reduced energy losses. In one respect, exercise apparatus 20 can eliminate the use of clutch belts or pulleys because a common continues belt 314 is provided to interlink or interconnect travelers 380 (and thus belts 323) without engaging inertia shaft 318 or pulleys 310. Moreover, common belt 314 does not directly drive inertia transfer assembly (i.e., inertia drive shaft 318)to energize flywheel/brake 306. Instead, the user drives the inertia transfer assembly by utilizing travelers 380 to drivingly engage inertia belts 323, which drives inertia drive shaft 318.

Referring to FIG. 4, common belt 314 is rotatably engaged about an idler pulley 309 and an idler pulley 308. Travelers 380 are permanently coupled to the common belt 314 on opposite side of the belt at locations which divide the belt into two equidistant segments. Accordingly, when belt 314 is moved in a reciprocal manner (shown by arrow YY) by user action on the travelers 380, common belt 314 assures that travelers 380 are moving in generally opposite directions.

Referring now to the side elevation views of FIGS. 2 and 3, inertia belts 323 is supported by a resilient suspension system which includes pulleys 310 and 311. At any given time during operation of the exercise apparatus 20, belt 323 may be described as having an upper portion 323*a* and a lower portion 323*b*. In yet another inventive aspect of apparatus 20, the belt system is configured such that rail 382 does not directly engage or directly support inertia belt 323 and inertia belt 323. This configuration provides more flexibility to inertia belt 323 and allows inertia belt 323 to frictionally engage traveler 380 independent of the track 382. Moreover, belt 323 can be used as part of a shock absorber system of the exercise apparatus which, when engaged by travelers 380, biases travelers 380 toward the inclined or inactive position.

As described above, foot base portion 380*a* includes wheels 381 for rollingly engaging the inside track of rail 382. Pressure arm 380*b* is equipped with a support roller 390 that is fixed at an intermediate location on the arm 380*a* and a coupling member 391 fixed at the end. The coupling member 391 has an extended engagement surface 391*a* that is particularly adapted to frictionally engaging the lower portion 323*b* of belt 323. The support roller 390 is configured to frictionally engage the upper portion 323*a* of belt 323, as shown in FIGS. 2 and 3. In a forward moving mode of the foot traveler 380, as shown in FIG. 2, traveler 380 is supported by wheels 381 which engage rail 382 and is confined therein and by support roller 390 which rollingly engages upper portion 323*a* of belt 323. In this forward moving mode, tension or spring forces of belt 323 acting through engagement of upper portion 323*a* and roller 390 causes traveler 380 to be slightly rotated in the clockwise direction (see reciprocating rotational path XX) and pivot about wheels 381. Pressure arm 380*b* is, therefore, moved upwardly such that coupling member 391 disengages lower portion 323*b* of belt 323.

As best shown in FIG. 3, belt 323 is rotatably supported about drive pulley 310 and idler pulley 311. FIG. 3 also depicts the suspension system as including a link assembly or link 385 including a suspension arm 385*a* and a pulley support arm 385*b*. The support arm 385*b* supports idler pulley 311 while suspension arm 385*a* is resiliently attached with a spring/shock absorber assembly or tensioner 386. The link 385 is pivotally supported about a pivot 384 that is fixed to front frame 301 or other rigid support. Tensioner 386 is pivotally attached at one end to suspension arm 385 while fixedly supported to frame 301 on an opposite end. The tensioner 386 may be one of several conventional types which are commercially available and generally known in the industry including, but not limited to, standard springs, coils and/or spring-shocks. A primary function of tensioner 386 is to provide tension or resiliency to belt 323 via link 385. During operation of apparatus 20, link 385 rotates about pivot 384 (i.e., in the clockwise direction when referring to FIG. 3) upon force being exerted by support roller 390 and/or coupling member 391 to belt 323. The combination of belt 323 and tensioner 386 also provides a shock or impact absorber for the apparatus 20, particularly when the user transfers weight or steps onto pedal 383. The combination of pulley 311, link 385 and tensioner 386 maybe referred to as a resilient support assembly for purposes of the present description.

FIG. 3 depicts traveler 380 in the rearward moving mode (moving from right to left in this view in the direction of arrow 350). In the rearward moving mode, the user steps down and exerts some body weight on foot pedal 383 and thus on traveler 380, thereby causing his foot to move rearwardly (right to left). As a result of pressure applied onto foot pedal 383, traveler 380 is rotated counterclockwise and coupling member 391 is moved downwardly to frictionally engage lower portion 323*b* of belt 323. Further, link 385 rotates in the clockwise is direction due to the downward flection in belt 323 which causes tensioner 386 to extend longitudinally outward. This extension of tensioner 386 provides a resisting force and damping to the system. As mentioned above, one advantageous result is a further reduction of the impact load experienced as the user applies force to exercise apparatus 20.

By frictionally engaging coupling member 391 with belt 323, the inertia transfer portion is coupled with one foot traveler 380. The inertia transfer portion is also indirectly coupled to the other traveler 380 through common belt 314 which is connected to both travelers 380. Thus, when coupling member 391 frictionally engages lower portion 323*b* of belt 323 (i.e., in the rearward moving mode depicted in FIG. 3), the inertia of the system is used to accelerate both travelers 380. It should be noted that the force applied to the belt 323 through foot pedal 383 and pressure arm 380*b* is applied at two places—through coupling member 391 frictionally engaging lower portion 323*b* and through support roller 390 rollingly engaging upper portion 323*b*. In this way, the tension applied on the belt 323 is reduced by approximately one-half of what it would be if the force was applied only through coupling member 391, for any given angular deflection of foot traveler 380.

It should again be noted that flywheel 306 provides an energy source for performing the function of accelerating the system as the foot travelers 380 changes direction. This energy, which is stored by flywheel 306 is supplied by the user In this respect, flywheel 306 performs instantaneously and continuously.

In yet another aspect of the invention, the inertia transfer assembly may include, or may be operable with, a second energy source such as a motor 399 (see FIGS. 2 and 3). Such a second energy source may be provided for continuously adding energy to the system and to compensate for energy losses due to friction and inertial direction changes. The utilization of two energy sources in this way further facilitates operation of exercise apparatus 20 and makes such operation almost transparent to the user. The user of the present inventive apparatus 20 needs only to support his weight while performing a running motion; the user does not need to apply any other force to the pedals 380 to keep the system in continuous motion.

In FIGS. 2 and 3, an electric motor 399 is shown as the second energy source. The motor 399 includes a pulley 399*a* which is rotatably coupled, via a belt 399*b*, with another pulley 399*c* that is disposed about, and rotatable with, inertia shaft 318. In the Figures, motor 399 is shown supported just below inertia shaft 318 with second pulley 399*b* disposed adjacent flywheel/brake 306. Unlike flywheel/brake 306, motor 399 is preferably energized by a source external to the inertia transfer assembly (e.g. a/c or d/c power), i.e., not by the user. Motor 399 is, however, operable to drive inertia drive shaft 318 and the rest of the inertia transfer portion.

In alternative embodiments, exercise apparatus 20 may employ a combination of a motor and inertia device such as a flywheel. In further alternative embodiments, an energy source in the form of a motor may serve dual functions as both the motor and inertia device. In such a case, a flywheel may be added to and become an integral part of the motor, or the armature of the motor may be designed to function as a flywheel. Control of a motor in any of these embodiments may be performed in one of several ways which are familiar to those skilled in the art. For example, a conventional torque controller may be used to power the motor and so as to overcome drag present in the system. Alternately, a velocity controller may be integrated and employed to power the motor so as to maintain a specified system velocity.

The present inventive exercise apparatus 20 enhances the workout of the user and provides for a more natural motion by essentially eliminating the need for the user to exert force to initiate movement of each traveler from zero velocity. The user of the inventive apparatus does not have to accelerate the traveler from zero velocity at the beginning of each active stroke to the velocity of a normal gait or system speed. Acceleration is instead achieved through utilization of the inertia drive system and/or another energy device such as a motor. Accordingly, the present invention can more accurately simulate normal constant speed activity, such as running.

Figure 5:
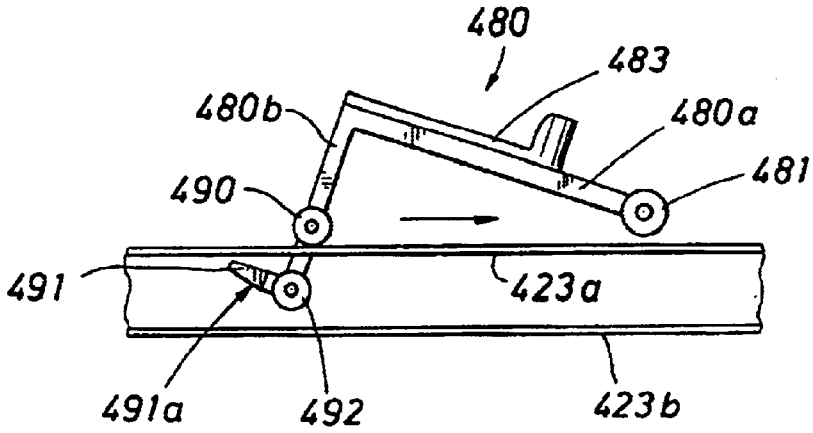
FIG. 5 is an elevation view of an alternate foot carriage assembly for the exercise apparatus shown in the forward moving mode.
Figure 6:
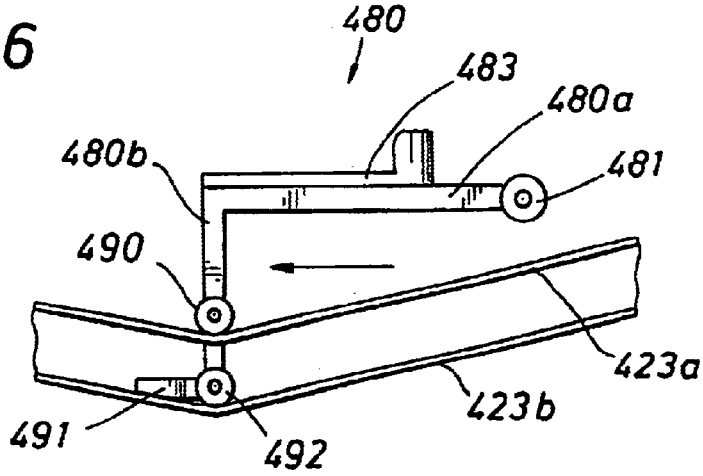
FIG. 6 is an elevation view of the foot carriage assembly of FIG. 5 shown in the rearward moving mode.

In the alternative embodiment depicted in FIGS. 5 and 6, exercise apparatus 20 employs an alternate foot traveler 480 according to the invention. FIG. 5 depicts traveler 480 in the forward moving mode while FIG. 6 depicts traveler 480 in the rearward moving mode. The foot traveler 480 is equipped with a second support roller 492 in addition to support roller 490, each of which is connected onto pressure arm 480*a*. Traveler 480 also has a coupling member 491 that extends outward from pressure arm 480*a* and has an engagement surface 491*a* for frictionally engaging lower portion 423*b* of belt 423. The second support roller 492 works in conjunction with first support roller 490 and coupling member 491 by engaging belt 423 as the traveler rotates counterclockwise but before engagement surface 491*a* engages lower portion 423*b* of belt 423. The second support roller 492 allows lower portion 423*b* of belt 423 to share, with first support roller 490, the load with upper portion 423*b* during intermediate angles of traveler rotation (i.e., during directional changes).

Figure 7:
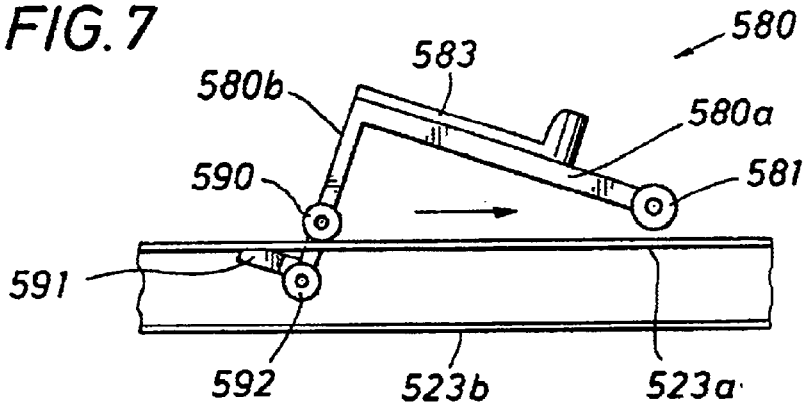
FIG. 7 is an elevation view of a second alternate foot carriage assembly for the exercise apparatus shown in the forward moving mode.
Figure 8:
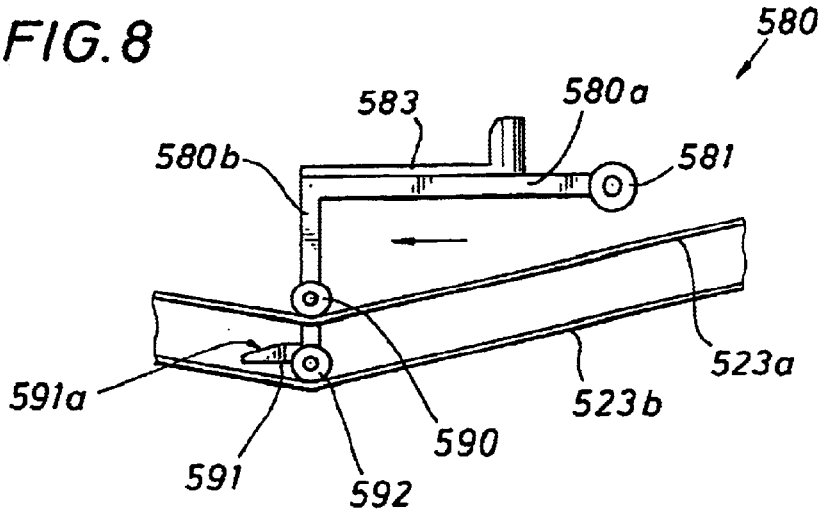
FIG. 8 is an elevation view of the foot carriage assembly of FIG. 7 shown in the rearward moving mode.

In the alternative embodiment depicted in FIGS. 7 and 8, exercise apparatus 20 employs yet another foot traveler 580 according to the invention. FIG. 7 depicts traveler 580 in the forward moving mode while FIG. 8 depicts traveler 580 in the rearward moving mode. The foot traveler 580 is equipped with a second support roller 592 in addition to support roller 590, each of which is attached to pressure arm 580*a*. Traveler 580 also has a coupling member 591 that extends outward from pressure arm 580*a* and has an engagement surface 591*a*. Unlike foot traveler 480 and other foot travelers, however, engagement surface 591*a* of traveler 580 is designed to frictionally engage upper portion 523*a* of belt 523 rather than lower portion 523*b*. The engagement surface 591*a* is an inclined surface that faces upward and is frictionally engageable with the bottom side of upper portion 523*a* when traveler 580 is rotated in the clockwise direction. Accordingly, traveler 523 is movable with upper portion 523*b* in the forward moving mode of traveler 523.

Figure 9:
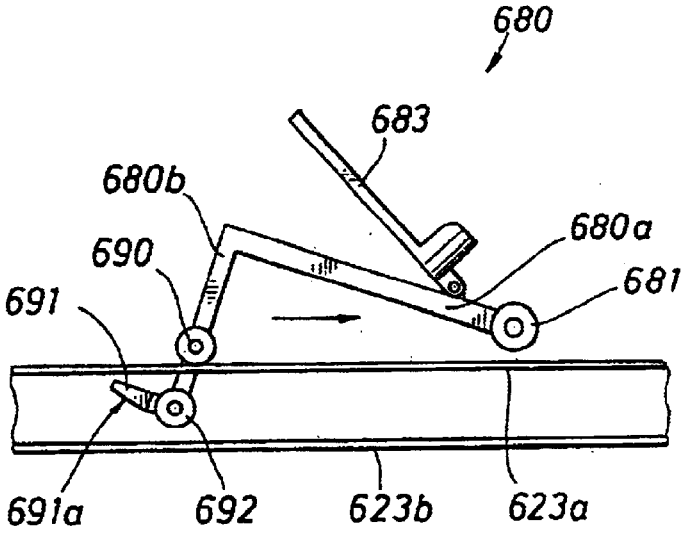
FIG. 9 is an elevation view of a third alternate foot carriage assembly for the exercise apparatus shown in the forward moving mode.
Figure 10:
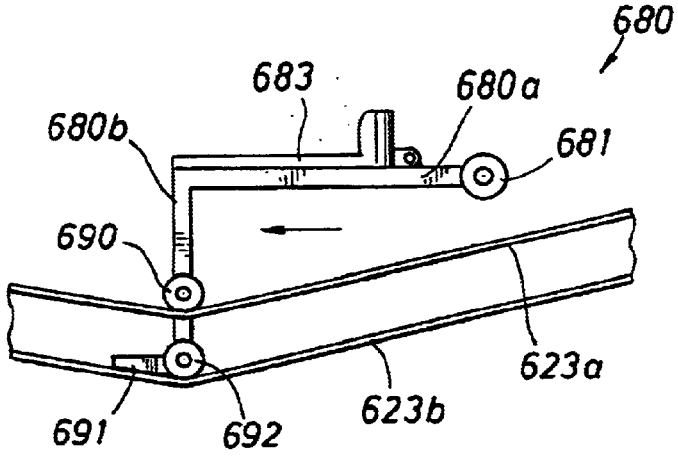
FIG. 10 is an elevation view of the foot carriage assembly of FIG. 9 shown in the rearward moving mode.

FIGS. 9 and 10 depict yet another embodiment of the exercise apparatus 20 according to the invention. The exercise apparatus 20 employs a traveler 680 that is equipped with a foot pedal 683 that is pivotable relative to the traveler 680. Through the foot pedal 683, traveler 680 extends the rotational range of motion of the user or more particularly, the user's foot. Among other attributes, this feature improves the user's comfort and flexibility. In further embodiments, a spring may be provided on traveler 680 to bias the engagement with foot pedal 683.

It should be noted that the travelers depicted and described with respect to FIGS. 2–10 may be used in combination with any other structural features of the inventive exercise apparatus 20. The selection of, and performance of, any necessary modification will be apparent to one skilled in the art, upon reading the above description, and the invention adapted to suit particular applications.

The foregoing description of the various aspects of the present invention has been presented for purposes of illustration and description. It is to be noted that the description is not intended to limit the invention to the exercise apparatus, its components and the method of operation disclosed herein. For example, various aspects of the invention may be applicable to other exercise apparatus or apparatus requiring reciprocal motion or simulating actual physical activity on a stationary frame, any of which will become apparent to one skilled in the relevant mechanical art who is provided with the present disclosure. Consequently, variations and modifications commensurate with the above teachings, and the skill and knowledge of the relevant art, are within the scope of the present invention. The embodiments of the inventive exercise apparatus described are further intended to explain best modes for practicing the invention, and enable others skilled in the art to utilize the invention in other embodiments and with various modifications required by the particular applications or uses of the present invention.

What is claimed is:

1. An exercise apparatus for enabling reciprocating motion of the user's legs or feet while the user remains generally stationary, said apparatus comprising:

a stationary frame;

a first longitudinal rail supported, at least partially, by said frame;

a second longitudinal rail supported, at least partially, by said frame and in generally parallel relation with said first rail;

a first foot carriage assembly movably engageable along said first rail;

a second foot carriage assembly movably engageable along said second rail;

an inertia drive assembly including an interconnection device interconnecting said carriage assemblies, a first and a second transmission device for said first and second carriage assemblies respectively, a drive shafts and a first energy device rotatably coupled with said drive shaft, said inertia drive assembly being disposed proximate said first and second rails and engageable with said first and second carriage assemblies via said first and second transmission devices such that said first energy device can accelerate said carriage assembly; and a second energy device engageable with said inertia drive assembly and adapted to transmit energy thereto.

2. The apparatus of claim 1, wherein said first energy device includes a flywheel rotatably mounted on said drive shaft.

3. The apparatus of claim 1, wherein said second energy device includes a motor supported proximate said inertia drive assembly and rotatably coupled with said drive shaft.

4. The apparatus of claim 3, wherein said motor is rotatably coupled with said drive shaft such that said motor continuously provides power to said inertia drive assembly during operation of said apparatus.

5. The apparatus of claim 1, wherein said first energy device is energized by movable operation of said first or second carriage assemblies, and said second energy device is energized by an external energy source.

6. The apparatus of claim 5, wherein said second energy device is adapted to substantially compensate for energy losses resulting from the use of said apparatus by the user.

7. The apparatus of claim 1, wherein said first transmission device includes a first continuous belt engageable with said first carriage assembly such that movable operation of said first carriage assembly drives said inertia drive assembly, and wherein said second transmission device includes a second continuous belt engageable with said second carriage assembly such that movable operation of said second carriage assembly drives said inertia drive assembly.

8. The apparatus of claim 7, wherein said inertia drive assembly and said first or second carriage assembly are interconnected such that, as said first or second carriage assembly initially advances rearwardly or forwardly, said inertia drive assembly accelerates said first or second carriage assembly up to a predetermined velocity without the user having to exert additional force to accelerate said carriage assembly.

9. The apparatus of claim 7, wherein each of said first and second carriage assemblies is frictionally engageable with one of said first and second belts to drive said belt in a first direction when said first or second carriage is moved in said first direction, and wherein said first or second carriage is disengageable from a substantially frictionally engaged relation with said belt to move in a second direction opposite said first direction.

10. The apparatus of claim 7, wherein said first and second carriage assemblies are interconnected such that said first carriage assembly can be accelerated in said second direction through movement of said second belt and said second carriage assembly can be accelerated in said second direction through movement of said first belt.

11. The apparatus of claim 10, wherein said interconnection device includes a common continuous belt interconnecting said first carriage assembly and said second carriage assembly such that when said first carriage assembly is moved one direction, said second carriage assembly is moved in the opposite direction.

12. The apparatus of claim 7, wherein each of said first and second belts is resiliently supported so as to deflect upon fictional engagement between said belt and one of said carriage assemblies.

13. The apparatus of claim 12, further comprising:

a first resilient support assembly engaging said first belt, said first support assembly being movably responsive to deflection of said belt; and a second resilient support assembly engaging said second belt, said second support assembly being movably responsive to deflection of said second belt.

14. The apparatus of claim 13, wherein each of said support assemblies includes a spring device interconnected with said first or second belt such that said spring device is resistant to deflection of said first or second belt.

15. The apparatus of claim 14, wherein each of said support assemblies includes a movable pulley interconnected between said spring device and said first or second belt, said movable pulley being shiftable upon deflection of said belt.

16. An exercise apparatus for enabling reciprocating motion of the user's legs or feet while the user remains generally stationary, said apparatus comprising:

a stationary frame;

a first longitudinal rail supported, at least partially, by said frame;

a second longitudinal rail supported, at least partially, by the frame and in generally parallel relation with said first rail;

a first foot carriage assembly movably engageable along said first rail;

a second foot carriage assembly movably engageable along said second rail;

a drive assembly disposed proximate said first and second rails and drivable upon movable operation of at least one of said first and second carriage assemblies, said drive assembly including a first continuous belt rotatably engageable with said first carriage assembly; and a second continuous belt rotatably engageable with said second carriage assembly; and a first suspension system for supporting said first belt; and a second suspension system for supporting said second belt;

wherein each of said first and second suspension systems includes a resilient support assembly responsive to deflection of said first or second belt upon frictional engagement between said first or second belt and one of said carriage assemblies.

17. The apparatus of claim 16, wherein each of said resilient support assemblies is interconnected with said first or second belt so as to add tension to said belt upon frictional engagement between said belt and one of said carriage assemblies.

18. The apparatus of claim 16, wherein each of said resilient support assemblies includes a spring device interconnected with said first or second belt such that said spring device is resistant to deflection of said belt.

19. The apparatus of claim 18, wherein each of said resilient support assemblies includes a movable pulley interconnected with said spring device, said first or second belt being rotatably supported about said movable pulley.

20. The apparatus of claim 19, wherein said movable pulley is supported so as to be shiftable upon deflection of said first or second belt.

21. The apparatus of claim 20, wherein said movable pulley is supported on an arm member pivotable about a pivot point, said movable pulley being arcuately movable about said pivot point upon loading of said belt by one of said carriage assemblies.

22. The apparatus of claim 20, wherein said spring device is interconnected with said movable pulley such that said spring device is resistant to shifting of said movable pulley.

23. The apparatus of claim 16, wherein each of said carriage assemblies includes a coupling member having an engagement surface for frictionally engaging one of said belts.

24. The apparatus of claim 23, wherein each of said carriage assemblies is releasably pivotable from a disengaged position relative to one of said belts to a position wherein said engagement surface frictionally engages said belt and is movable therewith.

25. The apparatus of claim 24, wherein each of said belts is adapted to bias said carriage assembly toward said disengaged position.

26. The apparatus of claim 25, further comprising a spring device interconnected with said movable pulley and responsive to shifting of said movable pulley, thereby biasing said belt to urge said carriage assembly toward said disengaged position.

27. The apparatus of claim 26, wherein said drive assembly and said first or second carriage assembly are interconnected such that, as said first or second carriage assembly initially advances rearwardly or forwardly, said drive assembly accelerates said first or second carriage assembly up to a predetermined velocity without the user having to exert additional force to accelerate said carriage assembly.

28. The apparatus of claim 16, wherein each of said first and second carriage assemblies is frictionally engageable with one of said first and second belts to drive said belt in a first direction when said first or second carriage assemblies is moved in said first direction, and wherein said first or second carriage assemblies is disengageable from a substantially frictionally engaged relation with said belt to move in a second direction opposite said first direction.

29. The apparatus of claim 28, wherein said first and second carriage assemblies are interconnected by a common continuous belt such that said first carriage assembly can be accelerated in said second direction through movement of said second belt by said inertia drive assembly and said second carriage assembly can be accelerated in said second direction through movement of said first belt by said inertia drive assembly.

30. The apparatus of claim 29, wherein said common continuous belt interconnects said first carriage assembly and said second carriage assembly such that when said first carriage assembly is moved one direction, said second carriage assembly is moved in an opposite direction.

31. The apparatus of claim 16, wherein said inertia drive assembly includes a drive shaft and a first energy device rotatably coupled with said drive shaft, said inertia drive assembly being disposed proximate said first and second rails and engageable with said first and second carriage assemblies such that, as said first or second carriage assembly initially advances from a point of change in direction along one of said rails, said first energy device can accelerate said carriage assembly; and a second energy device distinct from said first energy device, said second energy device being engageable with said inertia drive assembly and adapted to transmit energy thereto.

32. An exercise apparatus for enabling reciprocating motion of the user's legs or feet while the user remains generally stationary, said apparatus comprising:

a stationary frame;

a first longitudinal rail supported, at least partially, by said frame;

a second longitudinal rail supported, at least partially, by said frame and in generally parallel relation with said first rail;

a first foot carriage assembly movably engageable along said first rail;

a second foot carriage assembly movably engageable along said second rail;

an inertia drive assembly disposed proximate said first and second rails, said inertia drive assembly including a first transmission device engageable with said first carriage assembly such that movable operation of said first carriage assembly drives said inertia drive assembly;

a second transmission device engageable with said second carriage such that movable operation of said second carriage assembly drives said inertia drive assembly; and an interconnection device interconnecting said first and second carriage assemblies such that said inertia drive assembly can accelerate said each carriage assembly, through one of said first and second transmission devices.

33. The apparatus of claim 32, wherein said inertia drive assembly and said first or second carriage are interconnected such that, as said first or second carriage assemblies initially advances rearwardly or forwardly, said inertia drive assembly accelerates said first or second carriage assembly up to a predetermined velocity without the user having to exert additional force to accelerate said carriage assembly.

34. The apparatus of claim 32, wherein said first transmission device includes a first belt engageable with said first carriage assembly and said second transmission device includes a second belt engageable with said second carriage assembly.

35. The apparatus of claim 34, wherein each of said first and second carriage assemblies is frictionally engageable with one of said first and second belts to drive said belt in a first direction when said first or second carriage assembly is moved in said first direction, and wherein said first or second carriage assemblies is disengageable from a substantially frictionally engaged relation with said belt to move in a second direction opposite said first direction.

36. The apparatus of claim 35, wherein said first and second carriage assemblies are interconnected such that each of said first and second carriage assemblies can be accelerated in said second direction by said inertia drive assembly.

37. The apparatus of claim 36, wherein said first and second carriage assemblies are interconnected such that said first carriage assembly can be accelerated in said second direction through movement of said second belt and said second carriage assembly can be accelerated in said second direction through movement of said first belt.

38. The apparatus of claim 32, wherein said interconnection device includes a common continuous belt interconnecting said first carriage assembly and said second carriage assembly such that movement of said first carriage assembly results in movement of said second carriage assembly.

39. The apparatus of claim 32, further comprising an energy device distinct from said inertia drive assembly and interconnectible with said inertia drive assembly such that said energy device is operable to transmit power to said inertia drive assembly.

40. The device of claim 32, wherein said inertia drive assembly includes a first energy device adapted to be energized by operation of said first and second carriage assemblies, said apparatus further comprising a second energy device distinct from said first energy device and operable to transmit power to said inertia drive assembly.

41. The apparatus of claim 40, wherein said first energy device includes a flywheel mounted on an inertia drive shaft of said inertia drive assembly and said second energy device includes a motor rotatably coupled with said inertia drive shaft.

42. The apparatus of claim 32, wherein said first transmission device includes a first continuous belt engageable with said first carriage assembly and said second transmission device includes a second continuous belt engageable with said second carriage assembly, said exercise apparatus further comprising a first spring-biased movable pulley and a second spring-biased movable pulley, each of said movable pulleys being adapted to support at least a portion of one of said belts and is shiftable in response to deflection of said first or second belt.

43. The apparatus of claim 42, wherein said movable pulley is supported on an arm member pivotable about a pivot point, said movable pulley being arcuately movable about said pivot point upon loading of said belt by one of said carriage assemblies.

44. The apparatus of claim 42, further comprising a spring device interconnected with said movable pulley such that said spring device is resistant to deflection of said belt.

45. An exercise apparatus for enabling reciprocating motion of the user's legs or feet while the user remains generally stationary, said apparatus comprising:

a stationary frame;

a first longitudinal rail supported, at least partially, by said frame;

a second longitudinal rail supported, at least partially, by said frame and in generally parallel relation with said first rail;

a first foot carriage assembly movably engageable along said first rail;

a second foot carriage assembly movably engageable along said second rail;

an inertia drive assembly disposed proximate said first and second rails, said inertia drive assembly including a first continuous belt engageable with said first carriage assembly such that movable operation of said first carriage assembly drives said inertia drive assembly; and a second continuous belt engageable with said second carriage such that movable operation of said second carriage assembly drives said inertia drive assembly;

a first suspension system supporting said first belt such that said first belt deflects upon frictional engagement between said first belt and said first carriage assembly, said first suspension system including a spring-biased movable pulley that is shiftable upon deflection of said first belt;

a second suspension system supporting said second belt such that said second belt deflects upon frictional engagement between said second belt and said second carriage assembly, said second suspension system including a spring-biased movable pulley that is shiftable upon deflection of said second belt; and a common continuous belt interconnecting said first and second carriage assemblies such that, as each of said first and second carriage assemblies initially advances rearwardly or forwardly along one of said rails, said inertia drive assembly can accelerate said each carriage assembly, through one of said first and second transmission devices without the user having to exert additional force to accelerate said carriage assembly.

46. The apparatus of claim 45, wherein each of said suspension systems includes a spring device interconnected with said movable pulley, said spring device being adapted to resist deflection of said first or second belt so as to urge said frictionally engaged carriage assembly to a disengaged position away from said first or second belt.

47. The apparatus of claim 45, wherein said inertia drive assembly includes a drive shaft and a flywheel rotatably mounted on said drive shaft, said inertia drive assembly being disposed proximate said first and second rails and engageable with said first and second carriage assemblies such that, as said first or second carriage assembly initially advances from a point of change in direction along one of said rails, rotation of said flywheel can accelerate said carriage assembly; and an electric motor rotatably coupled with said inertia drive assembly and operable to continuously provide power to said drive shaft during operation of said apparatus.

48. The apparatus of claim 1, further including a motor having a flywheel providing said first energy device, said motor being engageable with said inertia drive assembly to transmit energy thereto.

49. The apparatus of claim 2, further comprising a motor, said motor providing said second energy device and including said flywheel.

50. An exercise apparatus for enabling reciprocating motion of the user's legs or feet while the user remains generally stationary, said apparatus comprising:

a stationary frame;

a first longitudinal rail supported, at least partially, by said frame;

a second longitudinal rail supported, at least partially, by said frame and in generally parallel relation with said first rail;

a first foot carriage assembly movably engageable along said first rail;

a second foot carriage assembly movably engageable along said second rail;

an interconnection device interconnecting said carriage assemblies;

a first and a second transmission device for said first and second carriage assemblies respectively; and an energy source assembly including a drive shaft engageable with said first and second transmission devices and a motor having an inertia device rotatably coupled with said drive shaft, said energy source assembly being disposed proximate said first and second rails and engageable with said first and second carriage assemblies such that, as said first or second carriage assembly initially advances rearwardly or forwardly along one of said rails, said inertia device can accelerate said carriage assembly;

wherein said motor is engageable with said drive shaft and adapted to transmit energy to said drive shaft and to said first and second transmission devices.

51. The apparatus of claim 50, wherein said inertia device includes a flywheel of said motor.

52. The apparatus of claim 50, wherein said inertia device includes an armature of said motor.

53. The apparatus of claim 50, wherein said motor is adapted to substantially compensate for losses resulting from the movable operation of said apparatus.

* * * * *